US005815765A

United States Patent [19]

Park

[11] Patent Number: 5,815,765

[45] Date of Patent: Sep. 29, 1998

[54] METHOD OF DRAWING OUT PAPER FROM LASER PRINTER WHEN JAM OCCUR

[75] Inventor: Byung-Oh Park, Kyungkdo, Rep. of Korea

[73] Assignee: SamSung Electronics Co., Ltd., Suwon, Rep. of Korea

[21] Appl. No.: 844,343

[22] Filed: Apr. 18, 1997

[30] Foreign Application Priority Data

Apr. 18, 1996 [KR] Rep. of Korea ..... 1996/11760

[51] Int. Cl.[6] ..... G03G 15/00

[52] U.S. Cl. ..... 399/18; 399/20; 399/21

[58] Field of Search ..... 399/18, 20–22

[56] References Cited

U.S. PATENT DOCUMENTS

| | | | |
|---|---|---|---|
| 4,443,101 | 4/1984 | Sakurai et al. | 399/22 |
| 4,579,441 | 4/1986 | Hart et al. | 399/315 |
| 4,766,459 | 8/1988 | Jinbo et al. | 399/398 |
| 4,889,463 | 12/1989 | Frost et al. | 414/416 |
| 5,133,919 | 7/1992 | Hasegawa et al. | 264/230 |
| 5,459,553 | 10/1995 | Kim | 399/20 |
| 5,479,240 | 12/1995 | Lee et al. | 399/21 |
| 5,502,545 | 3/1996 | Tsuruoka | 399/21 |
| 5,534,976 | 7/1996 | Kim | 399/18 |
| 5,606,407 | 2/1997 | Suzuki | 399/303 |
| 5,678,123 | 10/1997 | Kim | 399/21 |

*Primary Examiner*—William J. Royer
*Attorney, Agent, or Firm*—Robert E. Bushnell, Esq.

[57] ABSTRACT

A method of removing a paper from a laser printer when a jam occurs includes the steps of starting printing after initialization of a laser printer system, and ascertaining if a jam occurs during the printing performance. The method also includes the steps of proceeding with printing in the absence of a jam, and ascertaining if the cover of the system is opened and then closed when the jam occurs. The printing mechanism motor of the laser printer may be driven at its maximum motor speed, to remove the paper, when the cover is opened and then closed. The time required to clear jams is greatly decreased, thereby increasing the effectiveness of the use of the laser printer.

13 Claims, 5 Drawing Sheets

RELATED ART

METHOD OF DRAWING OUT PAPER FROM LASER PRINTER WHEN JAM OCCUR

CLAIM FOR PRIORITY

This application makes reference to, incorporates the same herein, and claims all benefits accruing under 35 U.S.C. §119 from my patent application entitled *Method Of Drawing Out Paper From Laser Printer When Jam Occur* earlier filed on the 18th day of April 1996 in the Korean Industrial Property Office and there assigned Serial No. 96-11760, a certified copy of which application is attached hereto.

BACKGROUND OF THE INVENTION

1. Field of the Invention

The present invention relates to printers such as laser printers. More particularly, the present invention relates to a method of rapidly removing a paper from such printers when a jam occurs during printing.

2. Description of the Related Art

During a printing process of a printer, papers may be jammed inside the printer. Typically, the cover of the printer is opened in order to remove the jammed paper. If the jammed paper is not easily removed, it is often removed after the paper cassette is taken out. Sometimes, the output tray of the printer is opened and the paper is afterwards removed.

Exemplars of contemporary project include Suzuki (U.S. Pat. No. 5,606,407, *Image Forming Apparatus With Jam Clearing Mechanism,* Feb. 25, 1997) discusses a paper folding member and a jam sensor which are disposed downstream of the position at which a transfer drum confronts an image carrying body and in proximity to the transfer drum. When a paper jam occurs, engagement between gears for transmitting a driving force from the image carrying body to the transfer drum is released, so that the transfer drum becomes freely rotatable in its normal rotational direction. The recording sheet can be taken out of the apparatus without getting separated from the transfer drum. Hasegawa et al. (U.S. Pat. No. 5,133,919, *Apparatus For Disposing Of A Used Thermal Stencil Master Sheet And A Process For Disposing Of The Same,* Jul. 28, 1992) discusses disposing of a used thermal stencil master sheet. The apparatus is provided with a stripping nail. Frost et al. (U.S. Pat. No. 4,889,463, *Slip Sheet Removal Apparatus,* Dec. 26, 1989) discusses an apparatus for removing a dunnage sheet disposed beneath a paperboard blank stack conveyed by a conveyor assembly. Jinbo et al. (U.S. Pat. No. 4,766,459, *Apparatus For Separating Transfer Paper From Photosensitive Member Of Copying Machine,* Aug. 23, 1988) discusses a transfer paper separating apparatus for separating transfer paper attracted by a photosensitive member of a copying machine from the photosensitive member. The transfer paper is separated by a separation belt and a separation roller. Hart et al. (U.S. Pat. No. 4,579,441, *Detaching Apparatus,* Apr. 1, 1988) discusses a electrostatographic apparatus comprising an imaging surface with an electrostatic transfer device to transfer toner particles to a receiving sheet and an apparatus to detack the sheet from the drum. Sakurai et al. U.S. Pat. No. 4,443,101, *Recording Paper Separation,* Apr. 17, 1984) discusses a copying machine in which a toner image is transferred from an image retaining member to a recording paper. The recording paper is separated from the image retaining member and ejected to the outside of the machine. From my study of the contemporary practice and the art, I have found that there is a need for an improved and more easily implemented technique for removing jammed paper from a laser printer.

SUMMARY OF THE INVENTION

Therefore, an object of the present invention is to provide an improved method of rapidly removing paper from printers when a jam occurs during printing.

Another object of the present invention is to provide an easier technique for clearing jams from a laser printer, in which paper is rapidly removed when the jam occurs during printing, to increase the effective use of the laser printer.

To accomplish these and other objects, the present invention provides a technique for removing a paper from a laser printer when a jam occurs, by starting printing after initialization of a laser printer system, and ascertaining if a jam occurs during the printing performance. This technique contemplates proceeding with printing in the absence of a jam, and ascertaining if the cover of the system is opened and then closed when the jam occurs. The printing mechanism motor of the laser printer may be driven at its maximum motor speed, to remove the paper, when the cover is opened and then closed.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

A typical printing process is electrophotography. An electrophotography processor creates visual images from an electrostatic latent image that attracts toner. This is subsequently fused to the paper according to the electric potential difference on a photosensitive drum. This electrophotographic process may be performed with: a charging technique, for charging the photosensitive drum; an exposure technique, for exposing the surface of a charged photosensitive drum with a light to create an electrostatic latent image; a developing technique for creating a visual image from the electrostatic latent image on the photosensitive drum using a developer; and a transfer technique, for transferring the image on the photosensitive drum to the paper.

Figure 1:
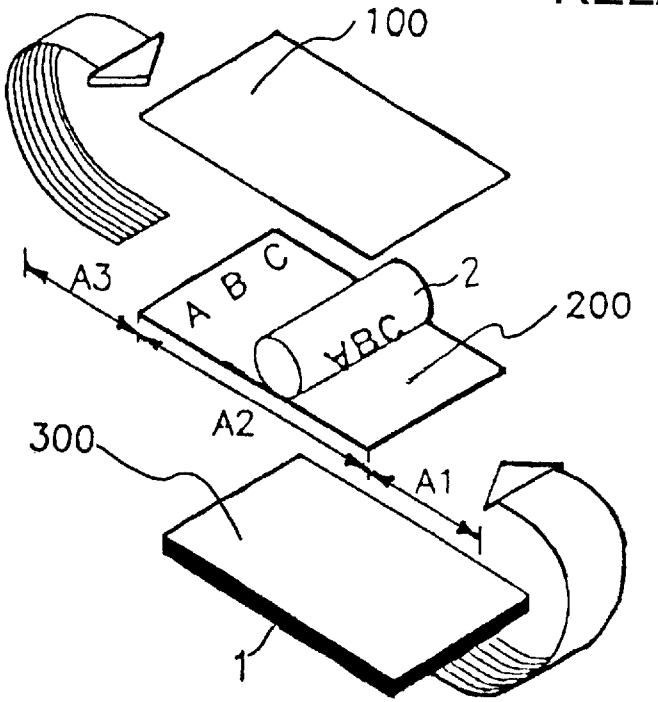
FIG. 1 illustrates a printing technique of a contemporary laser printer.

Turning now to the drawings, the printing operation of a laser printer, an electrophotographic process, is explained below. FIG. 1 shows the printing process of a general laser printer. Referring to FIG. 1, the printing process includes a first step A1 of supplying a paper 300, stored in a paper cassette 1, to a printer by a pick-up roller; a second step A2 of transferring an electrostatic latent image, formed on a photosensitive drum 2, to the supplied paper 200 using charging, exposing, developing and transferring processes; and a third step A3 of fusing the toner to the paper with heat and pressure using heating and compression rollers, and discharging the paper 100 on which printing is completed, from the printer.

Figure 2:
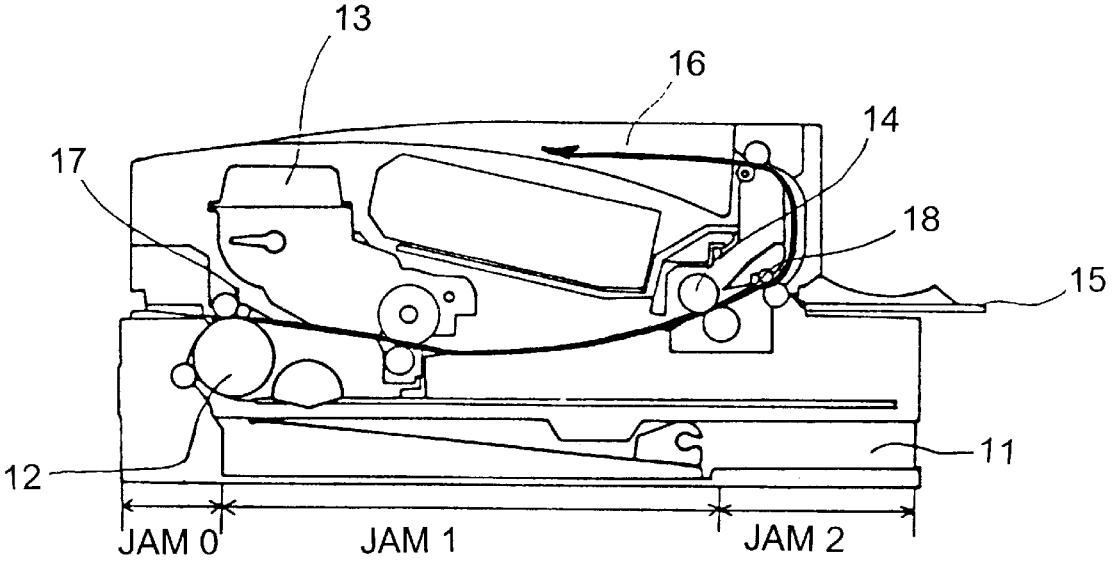
FIG. 2 RELATED ART
FIG. 2 is a cross-sectional view of a contemporary laser printer.

When printing is performed using the laser printer, a jam may occur in which paper is caught inside the printer. This jam, which occurs in the laser printer, is as explained below. FIG. 2 is a cross-sectional view of a contemporary laser printer. Referring to FIG. 2, the printer includes a cassette 11, in which paper is stored; a paper feeding roller 12, for supplying paper to the printing process; a developing section 13, for applying a toner image to the paper supplied by paper feeding roller 12; a paper output roller 14 for discharging the printed paper from developing section 13; a face-up and face-down output trays 15 and 16, to which the printed paper is discharged by paper output roller 14; and first and second sensors 17 and 18 for detecting paper jams.

"Jam 0," "Jam 1" "Jam 2," as shown in FIG. 2, indicate the locations where jams may occur. In FIG. 2, the arrows indicate the flow of the paper. In the laser printer, the paper flows in the direction indicated by the arrow so as to print the image thereon. The paper stored in cassette 11 reaches developing section 13 under the power of paper feeding roller 12. If the paper does not pass feeding roller 12, it is interrupted by the first sensor as a jam. This will be called "jam 0", indicating that the paper is caught in section A1 of FIG. 1.

After the paper passes through feeding roller 12, the image is printed on the paper by developing section 13. If the flow of paper stops during the image printing, a jam occurs. This will be called "jam 1", indicating that the paper is caught in section A2 of FIG. 1. This paper, on which the image is printed, is discharged to the output tray by output roller 14. If the paper does not pass output roller 14, this is interrupted by the second sensor 18 as a jam. This will be called "jam 2", indicating that the paper is caught in section A3 of FIG. 1. A contemporary method of removing jam 0, jam 1 and jam 2, which occur in the respective sections, is explained below with reference to the accompanying drawings.

Figure 3A:
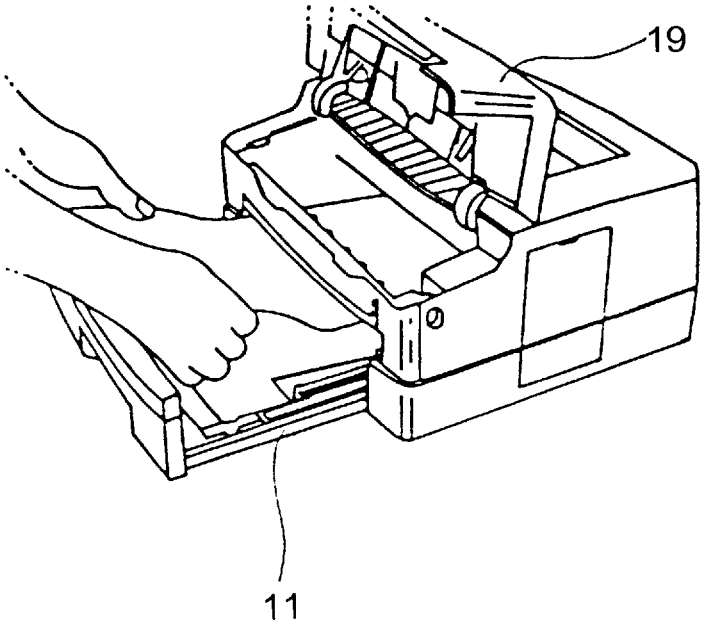
FIG. 3A RELATED ART
FIGS. 3A and 3B illustrate contemporary methods of removing jams occurring in a laser printer.
Figure 3B:
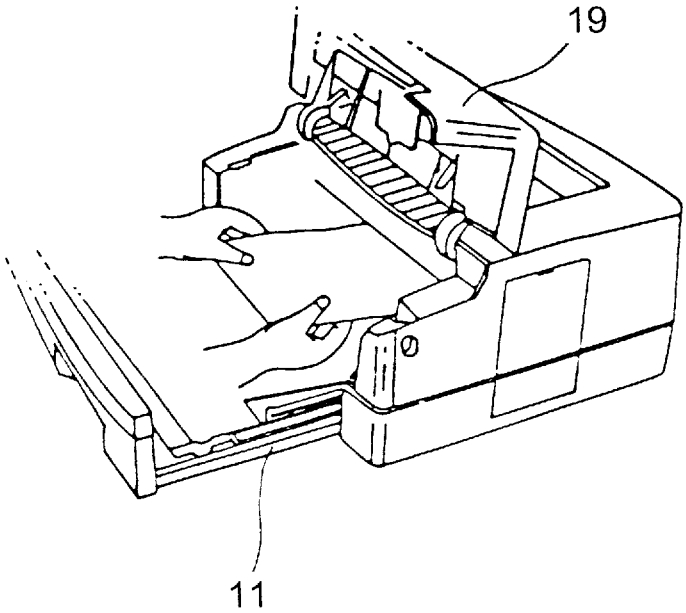
FIG. 3B RELATED ART

FIGS. 3A and 3B show a contemporary procedure for removing jams which occur in laser printers. FIG. 3 shows a cassette 11 and a top cover 19 opened and closed to remove a paper when it is jammed. FIGS. 3A and 3B show procedures for removing jam 0 and jam 1, respectively. Top cover 19 is opened in order to remove jam 1 which occurs during the printing operation in developing section 13, and is sensed by first sensor 17. To remedy this situation, the paper is removed. If the caught paper is not removed easily, it is removed after the cassette is taken out. When the paper is removed, the jam 0 and jam 1 are cleared. In order to remove the jam 2 sensed by second sensor 18, the output tray, located on the back of the printer, is opened and then the paper is removed.

To avoid this complicated jam clearing process in the laser printer currently described, when top cover 19 is opened and then closed, a sensor, sensing the jam, transmits a signal representing the jam to the motor controller of the printer, and the motor controller drives the printing mechanism motor of the printer, to thereby clear the jam. The laser printer drives its motor at the same speed as the printing speed, to remove the paper, and thus the jam is removed. However, since the printer drives the motor at the same speed as the printing speed to remove the paper, the time required to clear the jam increases. Accordingly, this is an inconvenient way to clear jams in the laser printer.

Figure 4:
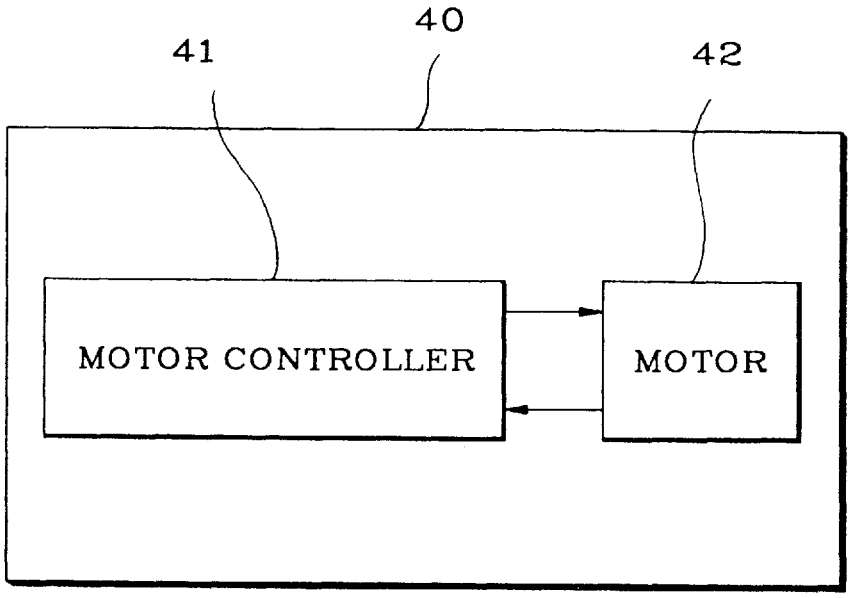
FIG. 4 is a block diagram of the printing mechanism motor of a laser printer according to the present invention.

FIG. 4 is a block diagram of the printing mechanism of a laser printer constructed according to the principles of the present invention. Referring to FIG. 4, the printing mechanism includes a motor controller 41 and a motor 42 driven by the motor controller. Motor controller 41 receives status information regarding motor 42 through a sensor, so as to drive it according to the corresponding status information. When a jam occurs during printing performance, motor controller 41 recognizes the status of the jam the sensor. When motor controller 41 also senses that the cover of the laser printer is opened and then closed, it drives the motor faster than the printing speed, to discharge the paper. Motor controller 41 drives the motor at the maximum speed, to thereby discharge the jammed paper.

Figure 5:
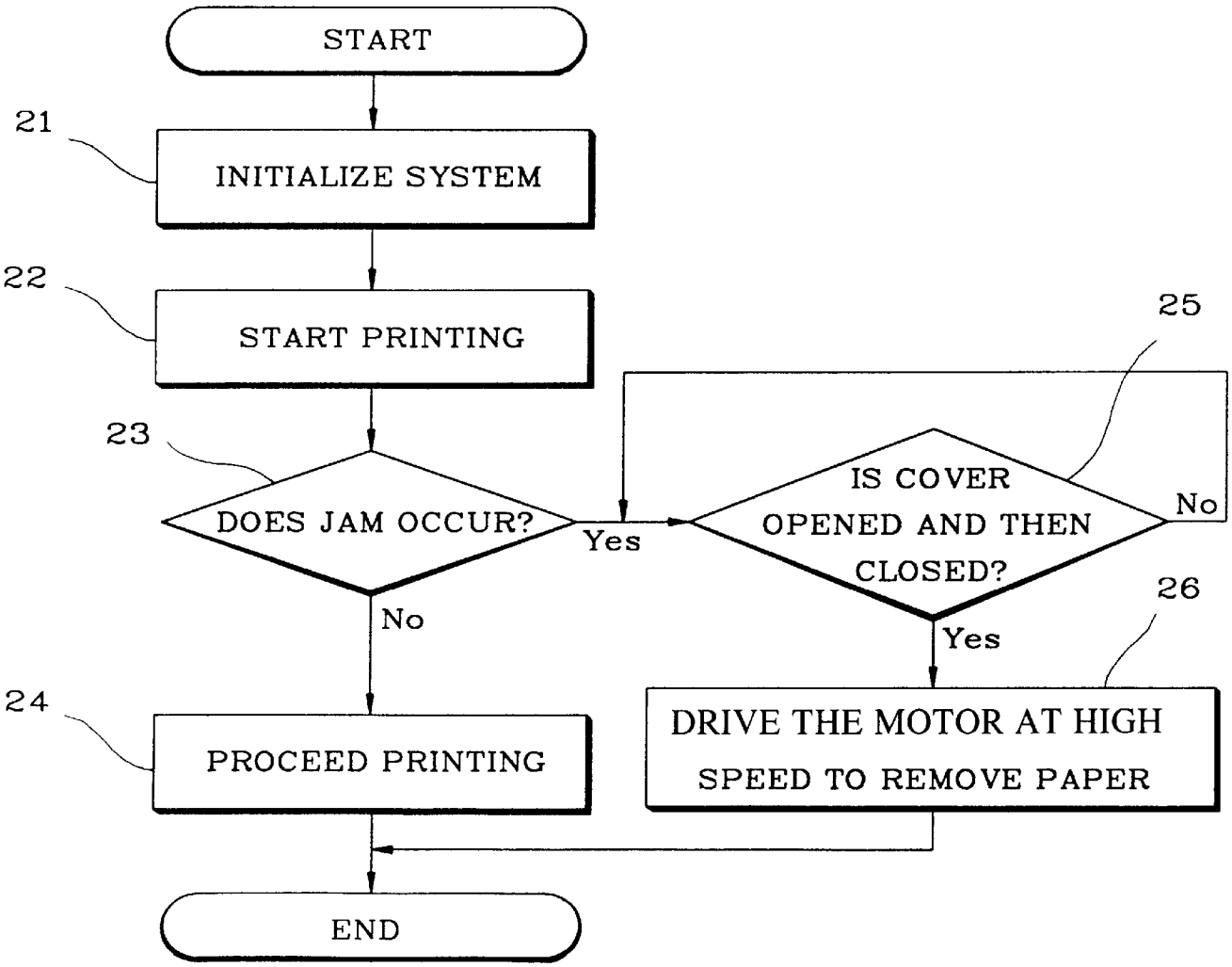
FIG. 5 is a flow chart showing a paper discharging process when clearing jams according to the present invention.

The laser printer, including printing mechanism 40, removes the paper when a jam occurs according to the process flow shown in FIG. 5. At step 21, motor controller 41 is turned on, and the system is initialized. At step 22, printing is started, and if a jam occurs during printing it is ascertained at step 23. When a jam does not occur, motor controller 41 controls motor 42 to proceed with the printing operation, thus completing its operation at step 24.

If a jam does occur at step 23, motor controller 41 ascertains if the cover of the system is opened and then closed or not at step 25. When the cover is opened and then closed, motor controller 41 drives the motor 42 at a higher speed to thereby remove the paper at step 26. This higher speed is often a speed which is faster than the motor driving speed during printing, but slower than the maximum motor speed of a driving section to be driven by the motor. That is, motor controller 41 controls motor 42, and ascertains if a jam occurs during printing or not. When a jam occurs, motor controller 41 drives the printing mechanism motor at the maximum speed to remove the paper. Therefore, it is possible to reduce the time during which the printer is inoperable when the jam is removed.

In a laser printer of the present invention, the printing mechanism motor of the printer may be driven at the maximum speed to remove a jam rapidly when a jam occurs during the printing operation. Accordingly, the time required to clear jams is greatly decreased, thereby facilitating a more effective use of the laser printer.

Therefore, it should be understood that the present invention is not limited to the particular embodiment disclosed herein as the best mode contemplated for carrying out the present invention, but rather that the present invention is not limited to the specific embodiments described in this specification except as defined in the appended claims.

What is claimed is:

1. A method of removing a cut sheet of paper from a laser printer when a paper jam occurs, comprising the steps of:

starting a printing activity after initialization of said laser printer in preparation for printing images upon cut sheets of paper conveyed along a path through the printer;

supplying one of the cut sheets of paper, from a paper cassette, to said laser printer via a feeding roller;

conveying the cut sheet of paper along a path by driving a printing mechanism motor of said laser printer at a first motor speed;

when a paper jam occurs, ascertaining whether said paper jam occurred during said printing activity;

when said paper jam does not occur during said printing activity, proceeding with said printing activity;

creating a visual image from an electrostatic latent image attracting a toner to be fused to the paper according to electric potential differences on a photosensitive drum;

charging a photosensitive drum;

developing an electrostatic latent image by exposing a surface of said photosensitive drum to a plurality of light;

developing a visual image from the electrostatic latent image on the photosensitive drum using a developer;

transferring a developed image on said photosensitive drum to the cut sheet of paper;

fusing said developed image to the cut sheet of paper by successively passing the cut sheet of paper against a heating roller and a compression roller, and discharging said cut sheet of paper from said laser printer;

when said paper jam occurs during said printing activity, ascertaining whether a cover of said laser printer is opened and then closed; and when said cover of said laser printer has been opened and then closed after occurrence of said paper jam, driving said printing mechanism motor of said laser printer at a second motor speed greater than said first motor speed to eject said cut sheet of paper.

2. The method of claim 1, wherein a first jam signal is transmitted when the cut sheet of paper is jammed before the cut sheet of paper passes said feeding roller, a second jam signal is transmitted when the cut sheet of paper is jammed in a developing section of said laser printer, and a third jam signal is transmitted when said cut sheet of paper is jammed before passing an output tray for holding discharged said cut sheet of paper.

3. The method of claim 1, wherein said second motor speed is less than a maximum motor speed of said printing mechanism motor.

4. A method of removing a sheet of paper from a printer when a jam occurs, the method comprising the steps of:

starting a printing activity after initialization of said printer, and ascertaining whether a paper jam occurs during the printing activity;

driving said sheet of paper along a paper path conveying said sheet of paper through said printer by driving a motor providing motive power to said printer at a first motor speed;

when said paper jam does not occur during said printing activity, proceeding with said printing activity in the absence of said paper jam;

when said paper jam occurs during said printing activity, ascertaining whether a cover of said printer has been opened and then closed; and when said cover of said printer has been opened and then closed, conveying said sheet of paper from said printer by driving said motor at a second motor speed greater than said first motor speed.

5. The method of claim 4, wherein said second motor speed is less than a maximum motor speed of said motor.

6. The method of claim 4, wherein a first jam signal is transmitted when said sheet of paper is jammed before passing a feeding roller, a second jam signal is transmitted when said sheet of paper is jammed in a developing section of said printer, and a third jam signal is transmitted when said sheet of paper is jammed after passing said developing section and before discharge into an output tray.

7. The method of claim 4, further comprising the steps of:

creating visual images from an electrostatic latent image attracting a toner to be fused to the paper according to electric potential differences on a photosensitive drum;

charging a photosensitive drum;

exposing a surface of said photosensitive drum with a plurality of light to generate an electrostatic latent image;

developing a latent toner image from said electrostatic latent image on said photosensitive drum by using a developer; and transferring said latent toner image on said photosensitive drum to said sheet of paper.

8. The method of claim 4, further comprising the steps of supplying said sheet of paper, stored in a paper cassette, to said printer by a pick-up roller;

transferring a latent toner image, formed on a photosensitive drum, to said sheet of paper;

fusing said latent toner image to said sheet of paper using a heating roller and a compression roller; and discharging said sheet of paper from said printer.

9. An apparatus for removing a paper from a printer when a paper jam occurs, comprising:

means for starting a printing activity after initialization of said printer, and ascertaining whether a paper jam occurs during said printing activity;

means for driving said paper along a paper path by driving a printing mechanism motor of said printer at a first motor speed;

means for proceeding with said printing activity in the absence of said paper jam, when said paper jam does not occur during said printing activity;

means for ascertaining whether a cover of said printer has been opened and then closed, when said paper jam occurs during said printing activity; and means for driving said printing mechanism motor of said printer at a second motor speed greater than said first motor speed, to remove said paper, when said cover of said printer has been opened and then closed.

10. The apparatus of claim 9, wherein said second motor speed is less than a maximum motor speed of said printing mechanism motor.

11. The apparatus of claim 9, wherein a first jam signal is transmitted when said paper is jammed before passing a feeding roller, a second jam signal is transmitted when said paper is jammed in a developing section of said printer, and a third jam signal is transmitted when said paper is jammed after said developing section and before being discharged to an output tray.

12. The apparatus of claim 9, further comprising:

means for creating visual images from an electrostatic latent image attracting a toner to be fused to the paper according to electric potential differences on a photosensitive drum;

means for charging a photosensitive drum;

means for exposing a surface of said photosensitive drum to a plurality of light to develop an electrostatic latent image;

means for developing a visual image from said electrostatic latent image on said photosensitive drum using a developer; and means for transferring a developed image on said photosensitive drum to said paper.

13. The apparatus claim 9, further comprising:

means for supplying said paper, stored in a paper cassette, to said printer by a pick-up roller;

means for transferring a latent toner image, formed on a photosensitive drum, to said paper;

means for fusing said latent toner image to said paper using a heating roller and a compression roller; and means for discharging said paper from said printer.

* * * * *